US010577542B2

(12) United States Patent
Weers et al.

(10) Patent No.: US 10,577,542 B2
(45) Date of Patent: Mar. 3, 2020

(54) LOW VISCOSITY METAL-BASED HYDROGEN SULFIDE SCAVENGERS

(71) Applicant: Baker Hughes, a GE company, LLC, Houston, TX (US)

(72) Inventors: Jerry J. Weers, Richmond, TX (US); Ross Poland, Houston, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 86 days.

(21) Appl. No.: 15/938,630

(22) Filed: Mar. 28, 2018

(65) Prior Publication Data

US 2018/0216014 A1 Aug. 2, 2018

Related U.S. Application Data

(60) Continuation-in-part of application No. 15/644,763, filed on Jul. 8, 2017, now abandoned, which is a division of application No. 14/183,109, filed on Feb. 18, 2014, now Pat. No. 9,719,027.

(60) Provisional application No. 61/766,512, filed on Feb. 19, 2013.

(51) Int. Cl.

| | |
|---|---|
| ***C10G 21/16*** | (2006.01) |
| ***C10G 29/22*** | (2006.01) |
| ***C10G 29/06*** | (2006.01) |

(52) U.S. Cl.

CPC ..... *C10G 21/16* (2013.01); *C10G 29/06* (2013.01); *C10G 29/22* (2013.01); *C10G 2300/207* (2013.01)

(58) Field of Classification Search

None

See application file for complete search history.

(56) References Cited

U.S. PATENT DOCUMENTS

| | | | | |
|---|---|---|---|---|
| 3,528,935 A | | 9/1970 | Marlon et al. | |
| 3,639,109 A | | 2/1972 | Badin | |
| 3,941,606 A | * | 3/1976 | Collins | C07C 51/418 106/243 |
| 4,100,144 A | | 7/1978 | Dunwald et al. | |
| 4,952,328 A | | 8/1990 | Davis et al. | |
| 4,981,602 A | | 1/1991 | Ripple et al. | |
| 5,575,951 A | | 11/1996 | Anderson | |

(Continued)

FOREIGN PATENT DOCUMENTS

| | | |
|---|---|---|
| EP | 2958973 A1 | 12/2015 |
| WO | 2005047178 A2 | 5/2005 |

(Continued)

OTHER PUBLICATIONS

L. Ghasemi-Mobarakeh, et al., "A Novel Method for Porosity Measurement of Various Surface Layers of Nanofibers Mat Using Image Analysis for Tissue Engineering Applications," Journal of Applied Polymer Science, vol. 106, Issue 4, 2007, pp. 2536-2541.

*Primary Examiner* — Joseph D Anthony

(74) *Attorney, Agent, or Firm* — Mossman, Kumar & Tyler, P.C.

(57) ABSTRACT

A method for scavenging hydrogen sulfide by introducing to a hydrogen sulfide contaminated fluid an additive comprising a zinc carboxylate complex and a viscosity improver selected from the group consisting of glycol ethers having from about 4 to about 10 carbons, alkyl alcohols having from about 1 to about 10 carbons, and combinations thereof.

18 Claims, 1 Drawing Sheet

(56) References Cited

U.S. PATENT DOCUMENTS

| | | | | |
|---|---|---|---|---|
| 6,599,472 | B1 * | 7/2003 | Hudson | A61L 9/01 422/1 |
| 9,353,026 | B2 * | 5/2016 | Poland | C07F 3/06 |
| 9,719,027 | B2 * | 8/2017 | Sandu | C10G 21/16 |
| 2002/0058745 | A1 | 5/2002 | Huang et al. | |
| 2002/0193257 | A1 | 12/2002 | Lee et al. | |
| 2004/0077753 | A1 | 4/2004 | Duvall et al. | |
| 2006/0229197 | A1 | 10/2006 | Stark et al. | |
| 2014/0231311 | A1 * | 8/2014 | Sandu | C10G 21/16 208/240 |
| 2015/0025258 | A1 * | 1/2015 | Poland | C07F 3/06 554/75 |
| 2018/0100096 | A1 * | 4/2018 | Wylde | C09K 8/532 |

FOREIGN PATENT DOCUMENTS

| | | | |
|---|---|---|---|
| WO | 2011081860 | A2 | 7/2011 |
| WO | 2011100301 | A2 | 8/2011 |
| WO | 201217771 | A2 | 12/2012 |
| WO | 2013181056 | A1 | 12/2013 |
| WO | WO/2016/180563 | * | 11/2016 |

* cited by examiner

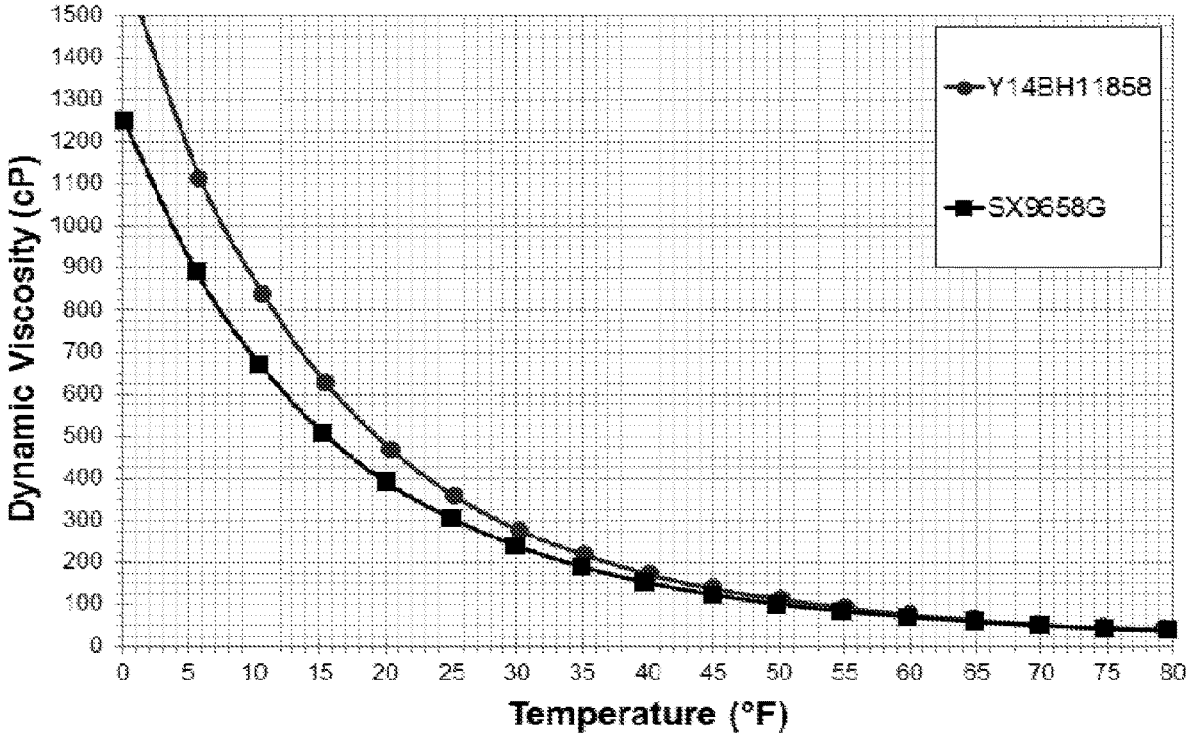
Dynamic Viscosity (cP)
1500
1400
1300
1200
1100
1000
900
800
700
600
500
400
300
200
100
0
0
5
10
15
20
25
30
35
40
45
50
55
60
65
70
75
80
Temperature (°F)
Y14BH11858
SX9658G

LOW VISCOSITY METAL-BASED HYDROGEN SULFIDE SCAVENGERS

CROSS-REFERENCE TO RELATED APPLICATIONS

This application is a continuation-in-part of U.S. patent Ser. No. 15/644,763 filed on Jul. 8, 2017, which is a divisional application of U.S. patent Ser. No. 14/183,109 filed on Feb. 18, 2014, issued on Aug. 1, 2017, as U.S. Pat. No. 9,719,027, which claims priority from U.S. Provisional Patent Application Ser. No. 61/766,512, filed on Feb. 19, 2013, all of which are incorporated herein by reference in their entireties.

BACKGROUND OF THE INVENTION

Field of the Invention

The present invention relates to additives for scavenging hydrogen sulfide. The present invention particularly relates to additives for scavenging hydrogen sulfide based upon metals such as zinc.

Background of the Art

The presence of sulfur species in hydrocarbon fluids and aqueous streams is undesirable for various reasons. The subterranean reservoirs currently being developed have increased amounts of sulfur species within the produced hydrocarbon streams (oil and gas). Hydrogen sulfide and mercaptans are toxic gases that are heavier than air and are very corrosive to well and surface equipment.

During combustion, sulfur-rich hydrocarbon streams also produce heavy environmental pollution. When sulfur-rich streams contact metals, sulfur species lead to brittleness in carbon steels and to stress corrosion cracking in more highly alloyed materials. Moreover, hydrogen sulfide in various hydrocarbon or aqueous streams poses a safety hazard and a corrosion hazard.

Zinc octoate, among other zinc carboxylates, are effective hydrogen sulfide scavengers. However, for example, when zinc octoate is prepared at a ratio of zinc to octanoic acid of 1:2, it has a very high viscosity which makes it difficult to handle and use. It would thus be desirable in the art to prepare the zinc carboxylate hydrogen sulfide scavengers having comparatively low viscosity.

SUMMARY OF THE INVENTION

In one aspect, there is disclosed method for treating fluids contaminated with hydrogen sulfide in which an additive useful for scavenging hydrogen sulfide is added or introduced to the fluid, the additive comprising (1) a zinc carboxylate complex of the formula $Zn_4O(carboxylate)_6$, wherein the carboxylate portion of the complex is formed from isobutyric acid and neodecanoic acid and (2) a viscosity improver selected from the group consisting of glycol ethers having from about 4 to about 15 carbons, and/or alkyl alcohols having from about 1 to about 10 carbons.

In yet another aspect, the additive may further comprise zinc octoate (1:2).

BRIEF DESCRIPTION OF THE DRAWINGS

FIG. 1 is a graph comparing, at various temperatures, the dynamic viscosity of a hydrogen sulfide scavenger comprising a zinc carboxylate complex and a viscosity improver as disclosed herein to the dynamic viscosity of a hydrogen sulfide scavenger comprising only 2-butoxyethanol.

DETAILED DESCRIPTION

It has been discovered that using zinc carboxylate hydrogen sulfide scavengers and a viscosity improver selected from the group consisting of glycol ethers having from about 4 to about 15 (20 or more) carbons, and/or alkyl alcohols having from about 1 to about 10 carbons, without or with additional hydrocarbons from about 7 to about 30 carbons, may be useful for scavenging hydrogen sulfide from fluids containing hydrogen sulfide without increasing the viscosity of the additive or the fluid.

It has been discovered that small amounts of certain glycol ethers and/or alkyl alcohols can produce dramatic changes in the viscosity of the zinc carboxylate. The glycol ethers useful with the method of the disclosure include those having from about 5 to about 15 carbons. Exemplary compounds include but are not limited to: ethylene glycol monomethyl ether; ethylene glycol monoethyl ether; ethylene glycol monopropyl ether; ethylene glycol monoisopropyl ether; ethylene glycol monobutyl ether; diethylene glycol monomethyl ether; diethylene glycol monoethyl ether; diethylene glycol mono-n-butyl ether; and combinations thereof.

The low molecular weight alkyl alcohols useful with the method of the disclosure include those having from about 1 to about 15 carbons. Exemplary alcohols include, but are not limited to: methanol; ethanol; propanol; isopropanol; hexanol; and combinations thereof.

In one embodiment, the zinc carboxylate may be a zinc carboxylate complex of the formula $Zn_4O(carboxylate)_6$, where two of the six moles of carboxylate are isobutyric acid and four are neodecanoic acid.

In another embodiment, zinc octoate, prepared using the ratio of 1:2 for zinc and octanoic acid, may be also used as a zinc carboxylate hydrogen sulfide scavenger, either alone or in combination with other zinc carboxylates. Note, the term "zinc octoate" for the purposes of this application is used to describe zinc organic based complexes salts, the reaction product of zinc resources (such as zinc powder and zinc oxide) and for example 2-ethyl hexanoic acid. This is the common industry usage and is employed herein to avoid confusion to those of ordinary skill in the art.

In addition to zinc, the method of the disclosure may also be employed with other metal octoates. Other metals that may be employed include, but are not limited to iron, manganese, cobalt, nickel, and the like. The use of mixed metal octoates is also within the scope of the disclosure.

The carboxylates may be prepared using any method known to be useful to those of ordinary skill in the art of making such compounds. For example, in one embodiment, a metal oxide is combined with ethyl hexanoic acid in the presence of acetic anhydride. Still, other methods may be employed wherein such methods result in a highly viscous additive. For the purposes of this disclosure, the term high viscosity when used in relation to a hydrogen sulfide scavenger, shall mean having a viscosity of greater than 60,000 centipoises at 60° F.

In addition to ethyl hexanoic acid, other carboxylic acids may be used with the method of the disclosure. Any carboxylic acid having from about 2 to about 18 carbons may be used to prepare metal carboxylates; subject to the proviso that the resulting composition is low enough in viscosity that it can be admixed with the viscosity improvers. Such acids include but are not limited to: acetic acid, isobutyric acid, propionic acid, hexanoic acid, nonanoic acid, decanoic acid, neo-decanoic acid, naphthoic acid, linoleic acid, naphthenic acid, tall oil acid, oleic acid, 2-methyl valeric acid, and the like. These other acids may be employed, but with the caveat that the resulting metal carboxylate has a higher viscosity prior to being mixed with the viscosity improver.

Also, most carboxylic acids are not available as pure reagents. For example, ethyl hexanoic acid in some grades may have as much as 10% other acids present. Deliberately mixed carboxylic acids may also be used and are within the scope of this application. In one embodiment, the zinc carboxylate may be the product of reacting oxide or hydroxide zinc and both octanoic acid and neo-decanoic acid for example. The use of anhydrides as a source of acid is also within the scope of the application.

The amount of additive in the fluid can range from about 1 ppm independently to about 4,000 ppm based on the total amount of the fluid, alternatively from about 1 ppm independently to about 2,500 ppm.

The amount of zinc carboxylate complex in the additive may range from about 40 wt. % independently to about 90 wt. %, alternatively from about 60 wt. % independently to about 80 wt. %. As used herein with respect to a range, "independently" means that any lower threshold may be used together with any upper threshold to give a suitable alternative range.

In an exemplary embodiment, the amount of viscosity improver in the additive ranges from about 0.5 wt. % to about 60 wt. %, based on the total amount of the additive.

The hydrogen sulfide scavengers produced herein shall have a viscosity lower than that specified as high viscosity above. The amount of discussed improver to be employed though, will be determined by the end user as a function of a balance between the economic cost of the viscosity improver and the capability of the process in which the scavenger is going to be employed. For example, in a refinery, one unit may require a very low viscosity, such as one that is less than 1,000 centipoises at 60° F. In contrast, perhaps even in the unit immediately next to the first unit, the hydrogen sulfide scavenger can be employed at a viscosity of 10,000 centipoises at 60° F.

In such an application, it may be desirable to reduce the amount of discussed improver employed. One of ordinary skill in the art of refining hydrocarbons will well know the capability of the units used for such refining. Generally though, the viscosity improver will be employed at a concentration of from about 1 wt. % independently to about 10 wt. %, based on the total amount of the additive. In some embodiments, the viscosity improver will be employed at a concentration of from about 1 independently to about 30%. In still other embodiments, the viscosity improver will be employed at a concentration of from about 0.5 wt. % independently to about 60 wt. %.

The hydrogen sulfide scavengers claimed herein are useful in treating hydrocarbons. The hydrocarbons may be crude, partially refined, or fully refined and pending commercial consumption. When the hydrocarbons to be treated are crude hydrocarbons, in one embodiment they may be very "crude" and be, for example, crude oil or heavy fuels oils or even asphalt. In another embodiment, the crude hydrocarbon may only be "crude" in regard to a subsequent refining step. For example, in one embodiment, the method of the disclosure may be a refining step to produce light hydrocarbon fuels such as gasoline or aviation fuel. In refineries, the feed streams for such units have already undergone at least one step to remove components that are not desirable for producing such fuels. Thus, in this embodiment, the feed stream to this unit is a crude hydrocarbon even though it has had at least one refining process step already performed upon it.

Crude oil, when first produced is most often a multiphase fluid. It will have a hydrocarbon phase, aqueous phase, and may include both gases and solids. In some applications of the method of the disclosure, the hydrogen sulfide scavengers maybe employed in process water such as that produced during crude oil refining and even in wastewater that may be similarly contaminated.

In addition to being useful for mitigating the presence of hydrogen sulfide, the compositions of the application may be further used as odor control agents during the handling, transport, and storage of hydrocarbons. A further benefit of the use of the invention is a reduction of SOx emissions. A scavenged hydrogen sulfide, or at least the vast majority of it, comes from recovery systems in modern refineries. The ultimate disposal point for such materials is generally a thermal oxidizer. The resultant SOx emissions can be reduced if the hydrogen sulfide never reaches the thermal oxidizer.

EXAMPLES

The following examples are provided to illustrate the present invention. The examples are not intended to limit the scope of the present invention and they should not be so interpreted. Amounts are in weight parts or weight percentages unless otherwise indicated.

Examples 1-5 & Comparative Examples A & B

No control of just a Zinc carboxylate is shown as it is too viscous to test. Sample 1 is prepared by first admixing acetic anhydride, butoxy ethanol and 2-ethylhexanoic acid. To this mixture zinc oxide is then added. The resulting material is then heated and refluxed to compete the reaction and then distilled to remove water.

Samples 2-3 are prepared similarly except that the alcohol is added after the formation of the zinc carboxylate. Note: the viscosity improvers may be added before, during or after the reaction.

Each mixture is then tested for viscosity and the results are shown below in Table 1.

TABLE 1

| Compositions | Sample | | | | | | |
|---|---|---|---|---|---|---|---|
| WT % | 1 | 2 | 3 | 4 | 5 | A | B |
| ZnO | 20.75 | 19.27 | 21.18 | 21.18 | 21.19 | 21.35 | 17.82 |
| 2-ethylhexanoic acid | 73.52 | 68.26 | 74.94 | 74.94 | 74.97 | 75.48 | 63.12 |
| Acetic Anhydride | 0.5 | 0.5 | 0.50 | 0.5 | 0.5 | 0.5 | 0.5 |
| Aromatic 150 | | 8.97 | | | | 2.67 | 18.56 |
| 2-(2-butoxyethoxy) ethanol | 5.23 | | | | | | |
| 2-butoxyethanol | | 3.00 | | | | | |

TABLE 1-continued

| Compositions | Sample | | | | | | |
|---|---|---|---|---|---|---|---|
| WT % | 1 | 2 | 3 | 4 | 5 | A | B |
| Isopropanol | | | 3.37 | | | | |
| Butanol | | | | 3.37 | | | |
| Methanol | | | | | 3.34 | | |
| Viscosity Cp @ 60° F. | | 6.6K | 16.7K | | | 468K | 68K |
| Viscosity Cp @ 68° F. | | | | 12.2K | | 397K | 52K |
| Viscosity Cp @90° F. | 18.9K | 1.8K | 3.8K | | | 173K | 40.6K |
| Viscosity Cp @ 100° F. | 14.8K | 1.2K | | | 1.8K | 142K | 32.4K |
| Viscosity Cp @ 120° F. | 10.0K | 600 | 1.2K | | | 95K | 21.1K |

Example 6

A crude oil stream was infused with about 2000 ppm hydrogen sulfide and then treated with the composition corresponding to Example 2 above. The test results are shown below in Table 2.

TABLE 2

| Test | Time after treatment | Dosage of Example 2 (ppm) | $H_2S$ ppm | % $H_2S$ Removed |
|---|---|---|---|---|
| 1 | 4 hrs | 0 | 2000 | N/A |
| 2 | 4 hrs | 700 | 350 | 82.5 |
| 3 | 4 hrs | 350 | 675 | 66 |
| 4 | 24 hrs | 700 | N/D | 100 |
| 5 | 24 hrs | 350 | 70 | 96 |

Example 7

FIG. 1 shows a graph comparing two viscosity reducing additives that may be used for hydrogen sulfide scavenging. One of the additives, SX9658G, comprises a zinc isobutyrate/neodecanoate complex and 2-ethylhexanol. The other additive, Y14BH11858, is made up of 2-butoxyethanol alone. As shown in FIG. 1, SX9658G maintains a lower dynamic viscosity than the Y14BH11858 does throughout a range of temperatures.

In the foregoing specification, the invention has been described with reference to specific embodiments thereof, and has been described as effective in providing methods for removing hydrogen sulfide from fluids containing them. However, it will be evident that various modifications and changes can be made thereto without departing from the broader scope of the invention as set forth in the appended claims. Accordingly, the specification is to be regarded in an illustrative rather than a restrictive sense. For example, specific aqueous and/or hydrocarbon fluids, additives, zinc carbonate complexes, viscosity improvers, proportions and treatment conditions falling within the claimed parameters, but not specifically identified or tried in a particular method, are expected to be within the scope of this invention.

The present invention may suitably comprise, consist or consist essentially of the elements disclosed and may be practiced in the absence of an element not disclosed. For instance, a method for treating fluids contaminated with hydrogen sulfide may comprise, consist essentially of, or consist of, introducing into a hydrogen sulfide contaminated fluid an additive in an amount effective for scavenging hydrogen sulfide, the additive comprising, consisting essentially of, or consisting of (1) a zinc carboxylate complex of the formula $Zn_4O(carboxylate)_6$, wherein the carboxylate portion of the complex is formed from isobutyric acid and neodecanoic acid and (2) a viscosity improver selected from the group consisting of glycol ethers having from about 4 to about 15 carbons, alkyl alcohols having from about 1 to about 10 carbons, and combinations thereof.

The words "comprising" and "comprises" as used throughout the claims, are to be interpreted to mean "including but not limited to" and "includes but not limited to", respectively.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "an," and "the" are intended to include the plural forms as well, unless the context clearly indicates otherwise.

As used herein, the term "and/or" includes any and all combinations of one or more of the associated listed items.

As used herein, relational terms, such as "first," "second," "top," "bottom," "upper," "lower," "over," "under," etc., are used for clarity and convenience in understanding the disclosure and do not connote or depend on any specific preference, orientation, or order, except where the context clearly indicates otherwise.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

What is claimed is:

1. A method for treating fluids contaminated with hydrogen sulfide comprising introducing into a hydrogen sulfide contaminated fluid an additive in an amount effective for scavenging hydrogen sulfide, the additive comprising (1) a zinc carboxylate complex of the formula $Zn_4O(carboxylate)_6$, wherein the carboxylate portion of the complex is formed from two moles of isobutyric acid and four moles of neodecanoic acid and (2) a viscosity improver selected from the group consisting of at least one glycol ether having from about 4 to about 15 carbons, at least one alkyl alcohol having from about 1 to about 10 carbons, and combinations thereof.

2. The method of claim 1, wherein the additive zinc carboxylate complex is prepared using zinc powder or zinc oxide.

3. The method of claim 1, wherein the additive further comprises zinc octoate.

4. The method of claim 3, wherein the zinc octoate is prepared using ethyl hexanoic acid.

5. The method of claim 4, wherein the ethyl hexanoic acid is 2-ethyl hexanoic acid.

6. The method of claim 1, wherein the viscosity improver is a glycol ether selected from the group consisting of: ethylene glycol monomethyl ether; ethylene glycol monoethyl ether; ethylene glycol monopropyl ether; ethylene glycol monoisopropyl ether; ethylene glycol monobutyl ether; diethylene glycol monomethyl ether; diethylene glycol monoethyl ether; diethylene glycol mono-n-butyl ether; and combinations thereof.

7. The method of claim 1, wherein the viscosity improver is a low molecular weight alkyl alcohol selected from the group consisting of: methanol; ethanol; propanol; isopropanol; hexanol; and combinations thereof.

8. The method of claim 1, wherein the effective amount of additive ranges from about 1 to about 4000 ppm based on the total amount of the fluid, and wherein the amount of zinc carboxylate complex in the additive ranges from about 40 wt. % to about 90 wt. % and the amount of viscosity improver in the additive ranges from about 0.5 wt. % to about 60 wt. %, based on the total amount of the additive.

9. A method for treating fluids contaminated with hydrogen sulfide comprising introducing into a hydrogen sulfide contaminated fluid an additive in an amount effective for scavenging hydrogen sulfide, the additive comprising (1) a zinc carboxylate complex of the formula $Zn_4O(carboxylate)_6$, wherein the carboxylate portion of the complex is formed from two moles of isobutyric acid and four moles of neodecanoic acid, (2) zinc octoate, and (3) a viscosity improver selected from the group consisting of at least one glycol ether having from about 4 to about 15 carbons, at least one alkyl alcohols having from about 1 to about 10 carbons, and combinations thereof.

10. The method of claim 9, wherein the zinc octoate is prepared using ethyl hexanoic acid.

11. The method of claim 10, wherein the ethyl hexanoic acid is 2-ethyl hexanoic acid.

12. The method of claim 9, wherein the viscosity improver is a glycol ether selected from the group consisting of: ethylene glycol monomethyl ether; ethylene glycol monoethyl ether; ethylene glycol monopropyl ether; ethylene glycol monoisopropyl ether; ethylene glycol monobutyl ether; diethylene glycol monomethyl ether; diethylene glycol monoethyl ether; diethylene glycol mono-n-butyl ether; and combinations thereof.

13. The method of claim 9, wherein the viscosity improver is a low molecular weight alkyl alcohol selected from the group consisting of: methanol; ethanol; propanol; isopropanol; hexanol; and combinations thereof.

14. The method of claim 9, wherein the effective amount of additive ranges from about 1 to about 4000 ppm based on the fluid.

15. The method of claim 9, wherein the amount of zinc carboxylate complex in the additive ranges from about 40 wt. % to about 90 wt. % and the amount of viscosity improver in the additive ranges from about 0.5 wt. % to about 60 wt. %, based on the total amount of the additive.

16. A method for treating fluids contaminated with hydrogen sulfide comprising introducing into a hydrogen sulfide contaminated fluid an additive in an amount effective for scavenging hydrogen sulfide, the additive comprising (1) a zinc carboxylate complex of the formula $Zn_4O(carboxylate)_6$, wherein the carboxylate portion of the complex is formed from two moles of isobutyric acid and four moles of neodecanoic acid and (2) a viscosity improver comprises at least one glycol ether having from about 4 to about 15 carbons and at least one alkyl alcohol having from about 1 to about 10 carbons.

17. The method of claim 16, wherein glycol ether selected from the group consisting of: ethylene glycol monomethyl ether; ethylene glycol monoethyl ether; ethylene glycol monopropyl ether; ethylene glycol monoisopropyl ether; ethylene glycol monobutyl ether; diethylene glycol monomethyl ether; diethylene glycol monoethyl ether; diethylene glycol mono-n-butyl ether; and combinations thereof.

18. The method of claim 17, wherein the alkyl alcohol is selected from the group consisting of: methanol; ethanol; propanol; isopropanol; hexanol; and combinations thereof.

* * * * *